US007815213B2

(12) United States Patent
Damiani et al.

(10) Patent No.: US 7,815,213 B2
(45) Date of Patent: Oct. 19, 2010

(54) SAFETY BINDING FOR A BOOT ON A SKI

(75) Inventors: Laurent Damiani, Villaz (FR); Philippe Miette, Annecy le Vieux (FR)

(73) Assignee: Salomon S.A.S., Metz-Tessy (FR)

( * ) Notice: Subject to any disclaimer, the term of this patent is extended or adjusted under 35 U.S.C. 154(b) by 406 days.

(21) Appl. No.: 11/624,997

(22) Filed: Jan. 19, 2007

(65) Prior Publication Data

US 2007/0170696 A1 Jul. 26, 2007

(30) Foreign Application Priority Data

Jan. 20, 2006 (FR) ..... 06 00523

(51) Int. Cl.
*A63C 9/088* (2006.01)

(52) U.S. Cl. ..... 280/611; 280/623

(58) Field of Classification Search ..... 280/607, 280/611–637, DIG. 12, DIG. 13
See application file for complete search history.

(56) References Cited

U.S. PATENT DOCUMENTS

| | | | | |
|---|---|---|---|---|
| 4,121,854 | A | 10/1978 | Cornu | |
| 4,226,439 | A * | 10/1980 | Kirsch | 280/628 |
| 4,319,767 | A * | 3/1982 | Emilson | 280/614 |
| 4,545,598 | A * | 10/1985 | Spitaler et al. | 280/612 |
| 4,735,435 | A * | 4/1988 | Hornschemeyer et al. | 280/625 |
| 5,188,387 | A * | 2/1993 | Ruffinengo | 280/612 |
| 5,308,102 | A * | 5/1994 | Bildner | 280/612 |
| 5,411,283 | A * | 5/1995 | Nowak et al. | 280/618 |
| 5,498,017 | A * | 3/1996 | Rohrmoser | 280/633 |
| 6,659,494 | B1 * | 12/2003 | Martin | 280/612 |
| 7,073,812 | B2 * | 7/2006 | Rigal et al. | 280/611 |
| 7,104,564 | B2 * | 9/2006 | Martin et al. | 280/625 |
| 7,431,323 | B2 * | 10/2008 | Holzer et al. | 280/625 |
| 2004/0113393 | A1 * | 6/2004 | Rigal et al. | 280/631 |
| 2005/0167950 | A1 * | 8/2005 | Martin et al. | 280/618 |
| 2006/0192365 | A1 * | 8/2006 | Ettlinger et al. | 280/611 |

FOREIGN PATENT DOCUMENTS

| | | | |
|---|---|---|---|
| EP | 0 968 742 | A1 | 1/2000 |
| FR | 2 853 254 | A1 | 10/2004 |
| WO | WO-95/12440 | A1 | 5/1995 |

OTHER PUBLICATIONS

U.S. Appl. No. 11/624,981 (Damiani et al.), filed Jan. 19, 2007.

* cited by examiner

*Primary Examiner*—Jeffrey J Restifo
*Assistant Examiner*—Jacob Meyer
(74) *Attorney, Agent, or Firm*—Greenblum & Bernstein, P.L.C.

(57) ABSTRACT

An assembly for binding a boot to a ski, including a front retaining element that is releasable when the forces to which the front retaining element is subjected are greater than the prestress value of a first spring, a rear retaining element that is releasable when the forces to which the rear retaining element is subjected are greater than the prestress value of a second spring, the rear retaining element being mounted on a slide, and an electronically controllable additional release device. The additional release device includes a rotatable actuation mechanism, in the form of an electric motor. The additional release device includes a bar fixed to the rear retaining element or to the front retaining element, and is capable of moving longitudinally between an open position and a closed position, in reaction to the actuation of the additional release device.

12 Claims, 4 Drawing Sheets

SAFETY BINDING FOR A BOOT ON A SKI

CROSS-REFERENCE TO RELATED APPLICATION

This application claims priority under 35 U.S.C. §119 of French Patent Application No. 06.00523, filed on Jan. 20, 2006, the disclosure of which is hereby incorporated by reference thereto in its entirety.

BACKGROUND OF THE INVENTION

1. Field of the Invention

The invention relates to an assembly for binding a boot to a ski, the assembly including a front releasable retaining element and a rear releasable retaining element, and including an additional arrangement for supplementing the binding assembly, in the form of an electronic control.

2. Description of Background and Relevant Information

The patent document WO 95/12440 A1 discloses an assembly of the aforementioned type. In this document, the device includes a releasable front retaining element, a releasable rear retaining element, and additional opening device. Each of the front and rear retaining elements is a conventional mechanical binding element, i.e., either a toe piece or a heel piece, which frees the boot when it is subjected to a force greater than that of a given threshold. The threshold force corresponds to the pretensioning value to which the springs positioned in the toe and heel pieces are subjected.

The additional opening device is an electronically controlled latch, which frees the boot by allowing the free translation of the heel piece in a slideway. The latch is actuated with a vertical translational movement. In the normal resting position, it is kept in the low position by the force of a spring, whereas the latch is moved to the high position by the pressurization of an annular chamber surrounding the latch.

During the practice of skiing, but also under other conditions, impacts directed to the gliding apparatuses, i.e., the skis and the bindings, can be substantial. Such impacts can occur during jump landings, when passing over bumps, when such ski equipment falls while in storage or during handling, or even when the equipment is placed on the ground. With a translational release device, there is a risk of ill-timed movement of the device and, in some cases, such movement can cause an ill-timed release of the boot, i.e., when such a release is not intended or desired.

The patent document EP 0 968 742 A1 also discloses a similar device, in which a supplemental release device includes an electronically controlled latch. Although the latch is articulated about an axis, i.e., describing movement along an arc of a circle, such movement is not a rotary movement insofar as the portion of the movement of the latch that is active in blocking, i.e., the portion that in fact retains the plate, has a movement that is similar to a straight line portion. In fact, the latch has an articulation movement about an axis, the amplitude of which is substantially less than a quarter of a turn. Such a latch is essentially identical to a translational release latch, which is also subject to the risk of an ill-timed release.

The patent document FR 2 853 254 A1 discloses a conventional binding device having radio-controlled detachment mechanism controlled by buttons that are positioned on the ski poles. As in the device described in the document WO 95/12440 A1, the radio-controlled detachment mechanism only provides a relative safety. In fact, the control of such mechanism requires that the skier be alert and attentive and make good decisions at the right time, on the one hand, and to keep the ski pole handles in his/her hands, on the other hand. This is actually not a supplemental safety release, which requires quick, even immediate actuation. Moreover, the release speed is subject to the motor rotating speed. Furthermore, in order to be able to move the binding, the motor must be active throughout the movement, which entails substantial energy consumption.

SUMMARY OF THE INVENTION

The invention provides an assembly for binding a boot to a ski, including a releasable front retaining element and a releasable rear retaining element, as well as an electronically controlled additional opening mechanism for the binding, whose operation is more stable.

To this end, the invention provides an assembly for binding a boot to a ski, such assembly including a front retaining element that is releasable when the forces to which it is subjected are greater than the prestress value of a first spring, and a rear retaining element that is releasable when the forces to which it is subjected are greater than the prestress value of a second spring, and an additional electronically controllable release device, the additional release device including a rotatable actuation mechanism. A rotatable actuation mechanism is not subject to an ill-timed release as much as is a translational release mechanism.

In a particular embodiment of the invention, the additional, or supplemental, release device includes an actuation mechanism, the movement of which is at least equal to a quarter of a turn.

In a particular embodiment of the invention, the rotatable actuation mechanism includes an electric motor.

In a particular embodiment of the invention, the retaining element, whether front or rear, is mounted on a slide, and the supplemental release device includes a bar connected to such retaining element, either front or rear, which is longitudinally movable between a so-called "open" position and a so-called "closed" position in reaction to the actuation of the additional release device.

In a particular embodiment of the invention, the electric motor only initiates the release movement, the end of the release movement being generated by the forces to which the retaining element, either front or rear, is subjected. In the first phase of the release movement, the motor generates the movement; in the second phase of the movement, the movement is generated by the forces that are exerted on the retaining element. The electric motor is subjected to the rotation.

In a particular embodiment, the additional release device includes a tripper, and the bar includes a pin that can be retained by the tripper.

In a particular embodiment, the sole function of the electric motor is to initiate the rotational movement of the release device, which movement continues by means of the forces to which the retaining element, either front or rear, is subjected.

In a particular embodiment, the additional release device includes a plate that is rotationally driven about a first axis by the motor, and a first connecting rod connected to the plate, on the one hand, and to the bar, on the other hand.

BRIEF DESCRIPTION OF DRAWINGS

The invention will be better understood from the description that follows, with reference to the annexed drawings, and in which.

DETAILED DESCRIPTION OF THE INVENTION

Figure 1:
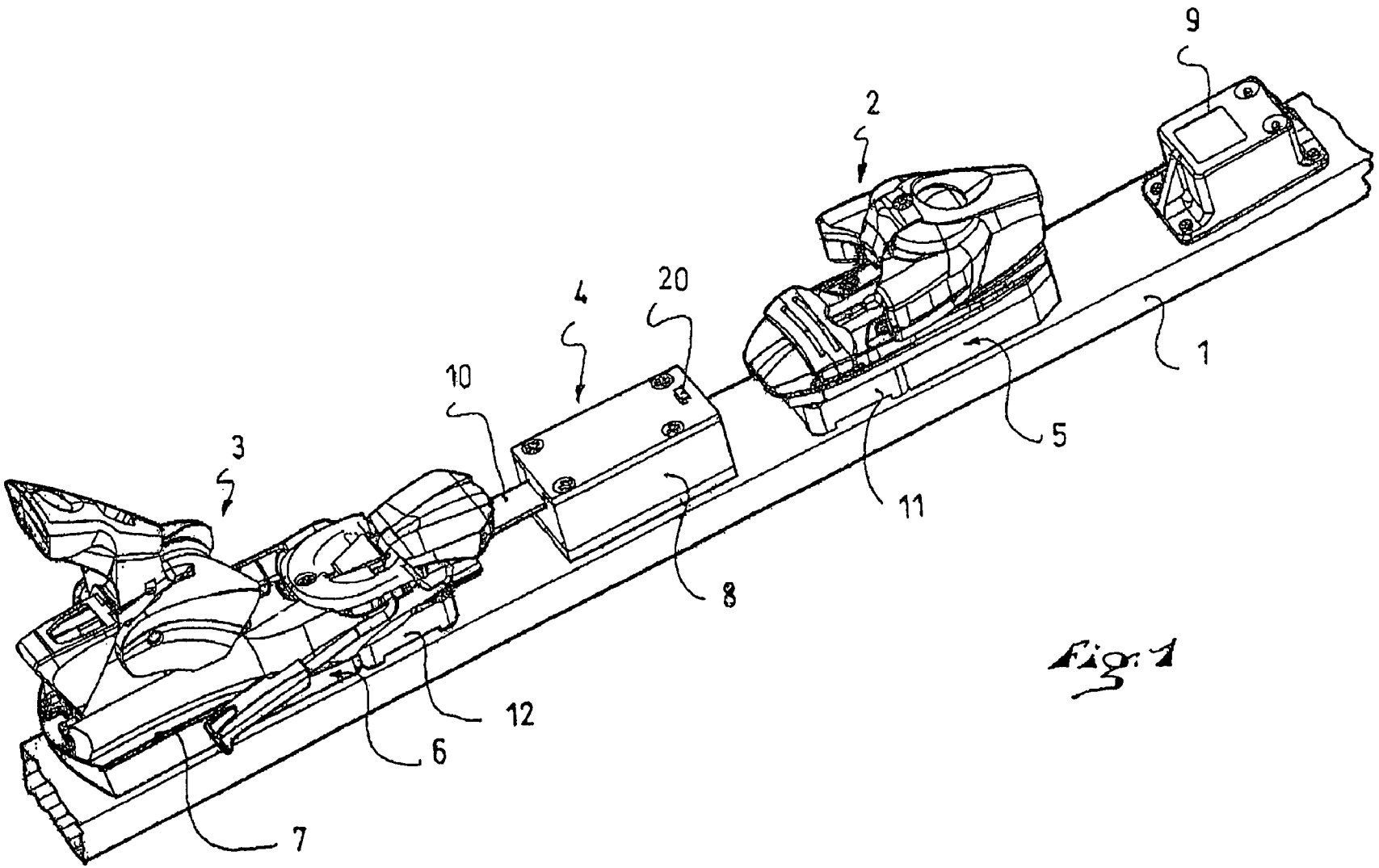
FIG. 1 is a perspective view of a first embodiment of the invention.

FIG. 1 shows a gliding apparatus including a ski 1, a front retaining element 2, a rear retaining element 3, and a supplemental, or additional, release device 4.

The front retaining element 2 is a conventional toe piece with mechanical release, meaning that the front retaining element 2 is released when the forces to which it is subjected are greater than the prestress value of a first spring positioned in the front retaining element 2.

The rear retaining element 3 is a conventional heel piece with mechanical release, meaning that the rear retaining element 3 is released when the forces to which it is subjected are greater than the prestress value of a second spring positioned in the rear retaining element 3.

The front retaining element 2 and rear retaining element 3 are mounted on a front interface element 5 and to a rear interface element 6, respectively, which elements are connected to the ski 1. These interface elements can be omitted within the scope of the invention.

In the arrangement shown and described, when the skier's leg is subjected to forces that are oriented in the horizontal plane of the ski, including torsional forces about a vertical axis, it is the front retaining element 2 releases and frees the boot. When the skier's leg is subjected to forces oriented in a vertical plane, the rear retaining element releases.

This arrangement is not limiting, and any other arrangement of a retaining element is possible within the scope of the invention.

The rear retaining element 3 includes a slide 7, or slideway, with respect to which the body of the rear retaining element 3 can slide.

The additional release device 4 includes an actuation box 8, a control box 9, and, positioned respectively at the front and rear interface elements 5 and 6, a front sensor 11 and a rear sensor 12.

The control box 9 includes an electronic circuit and a human/machine interface device, i.e., a user-interface device, with a display.

The actuation box 8 is connected to the body of the rear retaining element 3 by a bar 10, longitudinally movable by driving the body of the rear retaining element 3, which slides along the slideway 7.

When the front sensor 11 or the rear sensor 12 detects a force exceeding a certain threshold, the electronic circuit of the control box 9 generates a command for actuating a tripper 14. The bar 10 is then allowed to move, thereby moving the body of the rear retaining element 3 away from the front retaining element 2, which spacing is larger than the length of the boot, thereby releasing the boot.

Figure 2:
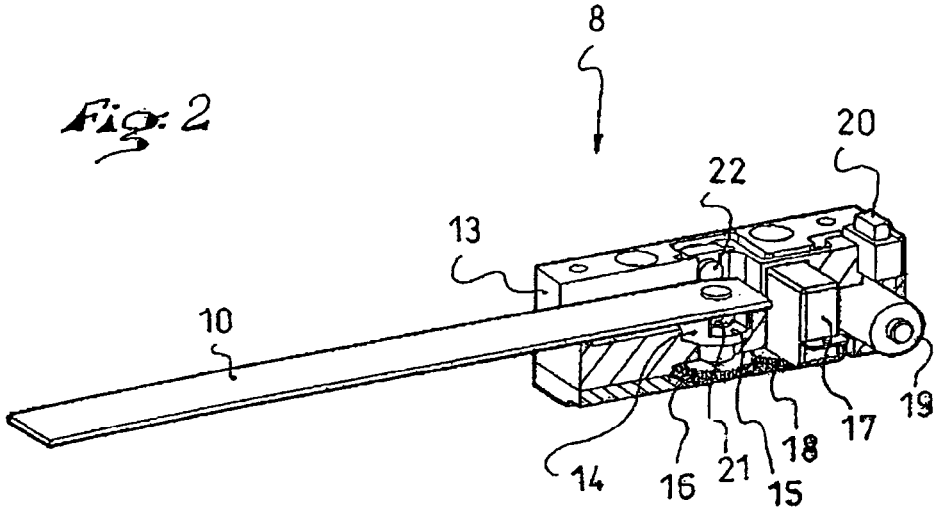
FIG. 2 is a perspective, partial cross-sectional view of the additional release device according to the first embodiment of the invention, when it is in the "closed" position.
Figure 3:
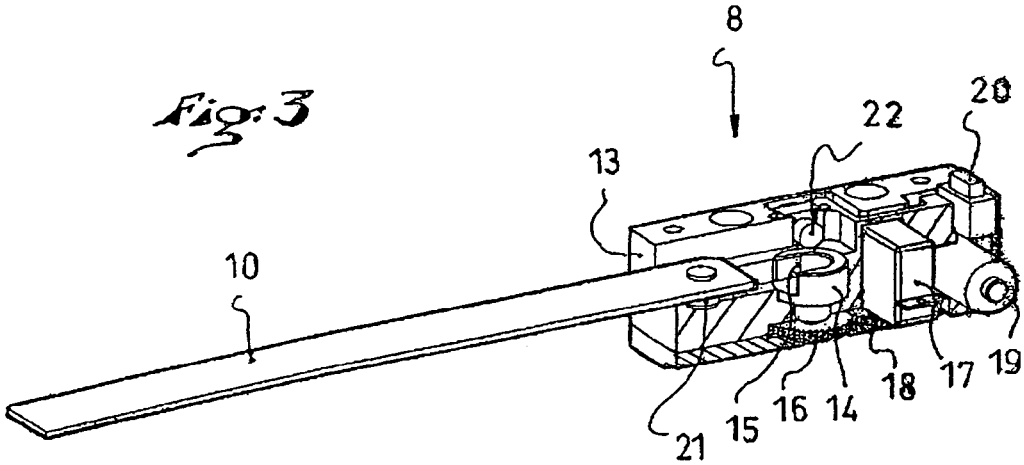
FIG. 3 is a view similar to FIG. 2, when the supplemental release device is in the "open" position.

FIGS. 2 and 3 show the actuation box 8 of the additional release device in the "closed" position and in the "open" position, respectively, of the additional release device.

The actuation box 8 includes a unit 13 that receives the various components of the actuation box 8. The unit 13 includes a longitudinal housing in which the bar 10 is received. A vertical well for receiving the tripper 14 is located at the end of the housing of the unit 13.

The tripper 14 is a rotary element. Its upper portion includes a recess 15, or notch, and its lower portion includes a first toothed wheel 16.

The additional release device is actuated by a rotary electric motor 17, the output shaft of which carries a second toothed wheel 18. The motor is powered by an electric cell/battery 19.

A cylindrical pin 21 is fixed to the end of the bar 10. In the closed position, the pin 21 is received in the recess 15 of the tripper 14.

The additional release device is shown in FIG. 2 in the "closed" position. In this position, the tripper 14 has an angular position so that the pin 21 cannot escape from the recess 15. With this arrangement, the ski binding functions in a manner similar to that of a conventional binding, i.e., the boot is released when the forces to which it is subjected exceed the prestress values of the springs.

The front sensor 11, the rear sensor 12, and the actuation box 8 are connected to the control box 9. At any time, the front and rear sensors 11, 12 transmit the forces to which they are subjected to the control box 9. The control box 9 processes this information and decides whether the boot should be released by opening the additional release device 4.

As soon as the control box 9 has determined that the detected information should allow the boot to be released, a command is transmitted to the motor 17, which begins rotating. The rotation of the second toothed wheel 18 drives the rotation of the first toothed wheel 16, with which it is engaged. The tripper 14 makes a quarter of a turn, i.e., a turn of 90 degrees, to the position shown in FIG. 3, such that the recess is open in the direction of the rear retaining element 3. In this position, the pin 21 is no longer retained and can escape from the recess 15. Consequently, the rear retaining element 3 is free to slide rearwardly as a result of the forces exerted on the boot, which spacing allows the boot to be released. In other words, the electric motor does not drive either of the retaining elements 2, 3 away from the boot to a release position. That is, the release of the boot is achieved, i.e., the spacing of the rear retaining element 3 from the front retaining element 2 in the release position of the additional release device, by means of the forces to which the retaining element, either front or rear, is subjected. In the first phase of the release by means of the additional release device 4, the motor generates rotary movement of the tripper 14; in the second phase of release by means of the additional release device, release movement of the rear retaining element 3 is generated by the forces that are exerted on the retaining element.

To have the boot again retained by the binding assembly, the skier must reset the additional release device. To this end, the skier must slide the rear retaining element 3 in a direction toward the front retaining element 2. The bar 10, affixed to the rear retaining element 3 in the illustrated embodiment, is also translationally moved in the same direction until the pin 21 is again received in the recess 15. When the pin 21 is in the recess 15, the bar 10 actuates a laterally positioned contactor 22. The contactor 22 initiates a new command for rotating the electric motor by a quarter of a turn, so that the tripper returns to the position shown in FIG. 2, i.e., the "closed" position.

A switch 20 is positioned on the unit 13 for switching off the device and for neutralizing the additional release device.

Figure 4:
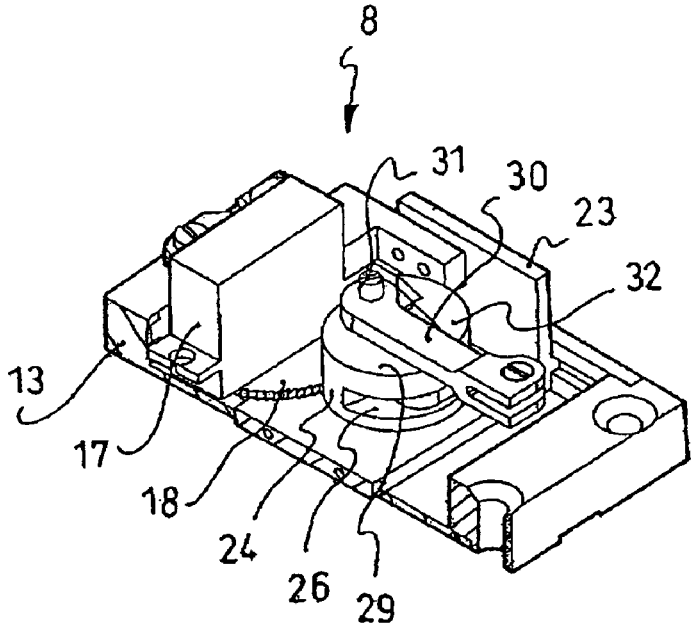
FIG. 4 is a perspective, partial cross-sectional view of the additional release device according to a second embodiment of the invention, when it is in the "closed" position.
Figure 5:
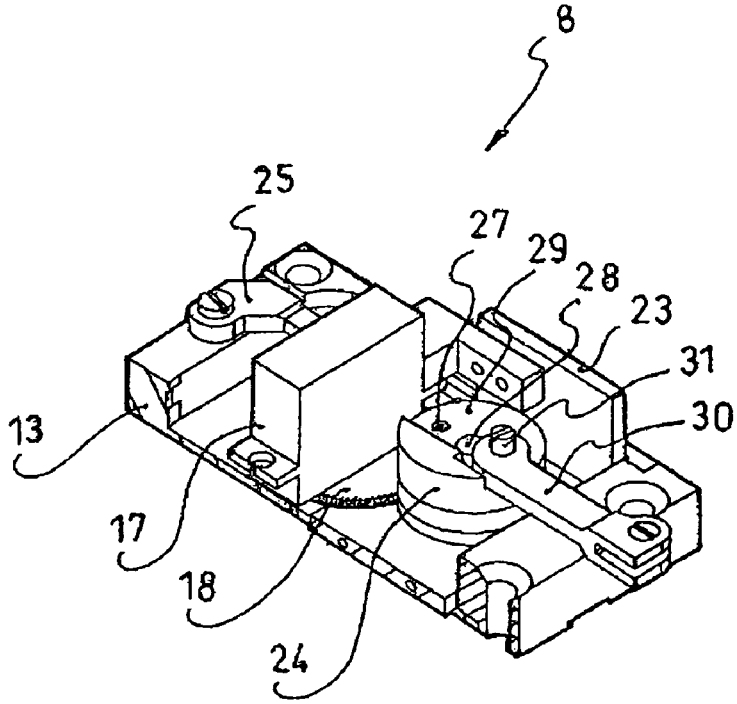
FIG. 5 is a view similar to FIG. 4, when the additional release device is in the "open" position.

FIGS. 4 and 5 illustrate the actuation box 8 according to a second embodiment of the invention. To simplify and to facilitate understanding, parts that differ from those of the first embodiment are described hereinafter.

The actuation box 8 includes a unit 13 that receives the various parts, including a carrier 23 that slides in a longitudinal direction. A plate 24 is mounted in the carrier and can rotate about a vertically oriented main axle 28. At the base of the plate 24 is located a first toothed wheel 16 (as in FIGS. 2 and 3), not shown in FIGS. 4 and 5, because it is hidden by the plate 24, which has a larger diameter.

An electric motor 17 is also fixed in the carrier 23. It includes, on its vertically oriented output shaft, a second toothed wheel 18 that is engaged with the first toothed wheel 16. The motor constitutes the rotatable actuation mechanism of the plate and, as described further below, of the additional release device.

A first connecting rod 25 is fixed in a lower notch 26 provided in the plate 24. The first connecting rod 25 is rotatably mounted via the first of its ends about a vertically oriented first secondary axle 27. The second end of the first connecting rod 25 is fixed on the unit 13. Due to the rotation of the plate 24, the fastening point of the first end of the connecting rod 25 moves about the main axle 28 by a distance equal to double the distance separating the main axle 28 and the first secondary axle 27. As a result, the carrier 23 slides in the unit 13.

The plate also includes an upper notch 29. The first end of a second connecting rod 30 is rotatably mounted about a second secondary axle 31 in the upper notch 29.

The second secondary axle 31 is diametrically opposed to the first secondary axle 27 with respect to the main axle 28.

The second end of the second connecting rod 30 is fixed to the bar 10 (not shown in FIGS. 4 and 5) which, as in the previous embodiment, is connected to the body of the rear retaining element 3.

The rotation of the plate 24, generated by the motor, drives the movement of the first end of the second connecting rod 30 by a distance equal to double the distance separating the main axle 28 from the second secondary axle 31.

The mechanism shown in FIG. 4 is in the "closed" position, i.e., when the rear retaining element 3 is against the ski boot. In this position, the main axle 28, the first secondary axle 27, and the second secondary axle 31 are not strictly aligned. Indeed, the second secondary axle 31 is slightly beyond the unstable equilibrium position that it would have if the three axles were aligned. Given that the rear retaining element 3 exerts a tensile force on the second connecting rod 30 through the bar 10, the plate 24 can remain in the arrangement shown in FIG. 4 only insofar as a stop 32, affixed to the plate, stops the rotation of the plate 24 when the latter is in contact with the second connecting rod 30.

When a release command is sent to the actuation box 8 by the control box 9, the rotatable actuation mechanism of the additional release device, constituted by the motor, rotates the plate 24 enough for the latter to exceed the unstable equilibrium point constituted by the alignment of the three axles 27, 28, and 31. The plate 24 is then automatically driven in rotation by the traction exerted thereon by the rear retaining element 3 through the bar 10 and the second connecting rod 30. When the rotation stops, the device is arranged as shown in FIG. 5. In this arrangement, the three axles 27, 28, and 31 are aligned.

In this embodiment, the motor only initializes the movement of the plate. As soon as the equilibrium point is exceeded, the electric motor no longer generates the movement, it is subject to.

Because of such a device, the translational path of the rear retaining element 3 is equal to double the distance separating the main axle 28 from the first secondary axle 27, increased by double the distance separating the main axle 28 from the second secondary axle 31.

Figure 6:
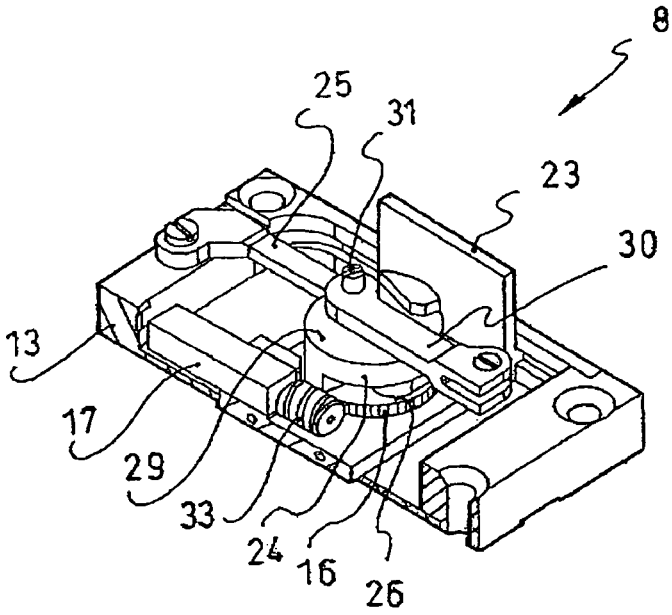
FIG. 6 is a perspective, partial cross-sectional view of the additional release device according to a third embodiment of the invention, when it is in the "closed" position.
Figure 7:
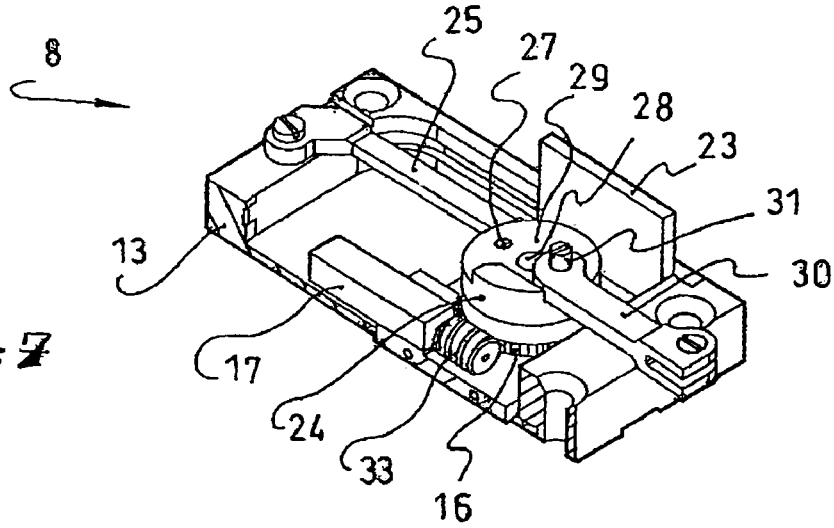
FIG. 7 is a view similar to FIG. 6, when the additional release device is in the "open" position.

FIGS. 6 and 7 illustrate a third embodiment of the invention, which differs from the preceding embodiment in that the plate 24 is rotationally driven by an electric motor 17 whose output shaft supports an endless screw 33. The functioning is similar, except that it is not necessary to provide a stop to terminate the rotation of the plate. Indeed, it is the endless screw that prevents the rotation.

The actuation box 8 includes a unit 13 that receives the various parts, including a carrier 23 sliding in a longitudinal direction. A plate 24 is mounted in the carrier and can rotate about a vertically oriented main axle 28. At the base of this plate 24 is located a first toothed wheel 16.

An electric motor 17 is also fixed to the carrier 23. An endless screw 33 is fitted to the horizontally oriented output shaft of the motor, the endless screw 33 being engaged with the first toothed wheel 16. The motor constitutes the rotatable actuating mechanism for the plate and, as described below, for the additional release device.

A first connecting rod 25 is fixed in a lower notch 26 provided in the plate 24. The first connecting rod 25 is rotatably mounted via the first of its ends about a vertically oriented first secondary axle 27. The second end of the first connecting rod 25 is fixed to the unit 13. Due to the rotation of the plate 24, the fastening point of the first end of the plate moves about the main axle 28 by a distance equal to double the distance separating the main axle 28 and the first secondary axle 27. As a result, the carrier 23 slides in the unit 13.

The plate also includes an upper notch 29. The first end of a second connecting rod 30 is rotatably mounted about a second secondary axle 31 in the upper notch 29.

The second secondary axle 31 is diametrically opposed to the first secondary axle 27 with respect to the main axle 28.

The second end of the second connecting rod 30 is fixed to the bar 10 (not shown in FIGS. 6 and 7) which, as in the preceding embodiment, is connected to the body of the rear retaining element 3.

The rotation of the plate 24, generated by the motor, drives the movement of the first end of the second connecting rod by a distance equal to double the distance separating the main axle 28 from the second secondary axle 31.

The mechanism shown in FIG. 6 is in the "closed" position, that is, when the rear retaining element 3 is against the ski boot. In this position, the main axle 28, the first secondary axle 27, and the second secondary axle 31 are, to the extent possible, strictly aligned. Given that the rear retaining element 3 exerts a tensile force on the second connecting rod 30 through the bar 10, this particular arrangement of the alignment of the three axles is theoretically unstable. However, it is made stable by the connection between the endless screw 33 and the first toothed wheel 16.

When a release command is sent to the actuation box 8 by the control box 9, the rotatable actuation mechanism of the additional release device, constituted by the motor, rotates the plate 24 enough for the latter to come out of the equilibrium position constituted by the alignment of the three axles 27, 28, and 31. The plate 24 is then automatically driven in rotation by the traction exerted thereon by the rear retaining element 3 through the bar 10 and the second connecting rod 30. When the rotation stops, the device is arranged as shown in FIG. 5. In this arrangement, the three axles 27, 28, and 31 are aligned again, in another stable configuration.

Due to such a device, the translational path of the rear retaining element 3 is equal to double the distance separating the main axle 28 from the first secondary axle 27, increased by double the distance separating the main axle 28 from the second secondary axle 31.

The invention is not limited to the particular several embodiments described above by way of examples. For example, the additional/supplemental release device can be structured and arranged so as to not act by translation of the rear retaining element, but by a pivoting of it, or by the translating or pivoting of the front retaining element; or yet by acting on the front retaining element and on the rear retaining element.

LIST OF ELEMENTS

1. ski

2. front retaining element

3. rear retaining element

4. supplemental release device

5. front interface element

6. rear interface element

7. slide

8. actuation box

9. control box

10. bar

11. front sensor

12. rear sensor

13. unit

14. tripper

15. recess

16. first toothed wheel

17. electric motor

18. second toothed wheel

19. electric cell/battery

20. switch

21. pin

22. contactor

23. carrier

24. plate

25. first connecting rod

26. lower notch

27. first secondary axle

28. main axle

29. upper notch

30. second connecting rod

31. second secondary axle

32. stop

33. endless screw

The invention claimed is:

1. An assembly for binding a boot to a ski comprising:

a front retaining element comprising a first spring adapted to be set at a prestress value, said front retaining element comprising a first release device releasable in response to an applied force greater than said prestress value of said first spring;

a rear retaining element comprising a second spring adapted to be set at a prestress value, said rear retaining element comprising a second release device releasable in response to an applied force greater than said prestress value of said second spring; and an additional release device electronically controllable to move, independent of said first and second springs, between:

(a) a closed position to prevent release of the boot by the additional release device; and (b) an open position to allow movement of one of the front and rear retaining elements relative to the ski from a boot retention position to a boot release position;

said additional release device comprising a rotatable actuation mechanism, said rotatable actuation mechanism comprising an electric motor which moves the additional release device from the closed position to the open position with the front and rear retaining elements maintained in the retention position.

2. An assembly for binding a boot to a ski comprising:

a front retaining element comprising a first spring adapted to be set at a prestress value, said front retaining element comprising a first release device releasable in response to an applied force greater than said prestress value of said first spring;

a rear retaining element comprising a second spring adapted to be set at a prestress value, said rear retaining element comprising a second release device releasable in response to an applied force greater than said prestress value of said second spring;

an additional release device, said additional release device being electronically controllable;

said additional release device comprising a rotatable actuation mechanism, said rotatable actuation mechanism comprising an electric motor;

said additional release device being operatively connected to at least one of the front and rear retaining elements;

each of the front and rear retaining elements being movable through at least one release movement path during release of the boot by means of the additional release device;

said electric motor of said additional release device only initiating movement of at least one of the front and rear retaining elements through said release movement path, a remainder of said movement being caused by pressures exerted on said one of the front and rear retaining elements other than by said electric motor, wherein: the remainder of said movement of said one of the front and rear retaining elements is caused by pressures exerted on the boot against said one of the front and rear retaining elements.

3. An assembly for binding a boot to a ski according to claim 1, further comprising:

a slideway, at least one of the front and rear retaining elements being mounted to slide in said slideway between the boot retention position and the boot release position of the additional release device;

said additional release device comprising a bar connected to said one of the front and rear retaining elements, said bar being movable longitudinally as the additional release device moves from the boot retention position to the boot release position;

in the boot release position of the additional release device, said one of the front and rear retaining elements is spaced farther from a second of the front and rear retaining elements than in the boot retention position;

said bar being operatively connected to said rotatable actuation mechanism at least in the boot retention position;

in reaction to actuation of the additional release device, the electric motor rotates the rotatable actuation mechanism to place the additional release device in an open position but not to place the additional release device in the boot release position.

4. An assembly for binding a boot to a ski according to claim 3, wherein:

said additional release device comprises a tripper;

the electric motor operatively connected to rotate the tripper; and said bar comprises a pin adapted to be retained in the tripper in the closed position of the additional release device and to be releasable from the tripper in the open position of the additional release device.

5. An assembly for binding a boot to a ski according to claim 4, wherein:

said additional release device comprises a mechanism to automatically reset the tripper.

6. An assembly for binding a boot to a ski according to claim 5, wherein:

said mechanism to automatically reset the tripper comprises a contactor actuated by said bar when said bar is in the closed position.

7. An assembly for binding a boot to a ski according to claim 3, wherein:

said additional release device comprises:

a plate rotationally driven about a first axis by said electric motor;

a first connecting rod fixed to said plate and to said bar.

8. An assembly for binding a boot to a ski according to claim 1, further comprising:

at least one sensor adapted to detect a force greater than said prestress value of at least one of the first and second springs; and an electronic control for receiving a signal initiated by said sensor and for generating a command for actuating said additional release device for allowing the boot to be released from the binding.

9. An assembly for binding a boot to a ski according to claim 1, wherein:

said rotatable actuation mechanism comprises rotation of at least 90 degrees in actuating said additional release device for allowing the boot to be released from the binding.

10. An assembly for binding a boot to a ski according to claim 1, wherein:

said electric motor is a rotary electric motor.

11. An assembly for binding a boot to a ski according to claim 1, wherein:

said rotatable actuation mechanism comprises a rotary element rotatable by means of said electric motor through at least 90 degrees in actuating said additional release device from the closed position to the open position for allowing the boot to be released from the binding.

12. An assembly for binding a boot to a ski according to claim 11, wherein:

said rotary element comprises a tripper or a plate;

said additional release device further comprising a bar operatively connected between said tripper or said plate and one of said front and rear retaining elements.

* * * * *